US009116460B2

(12) United States Patent
Matsuno et al.

(10) Patent No.: US 9,116,460 B2
(45) Date of Patent: Aug. 25, 2015

(54) REDUCING TONER ADHESION TO A DEVELOPMENT DEVICE OF AN IMAGE FORMING APPARATUS

(71) Applicants: Yasuhide Matsuno, Osaka (JP); Naoki Nakatake, Hyogo (JP); Yuji Nagatomo, Osaka (JP); Takahiro Sanada, Hyogo (JP)

(72) Inventors: Yasuhide Matsuno, Osaka (JP); Naoki Nakatake, Hyogo (JP); Yuji Nagatomo, Osaka (JP); Takahiro Sanada, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/092,879

(22) Filed: Nov. 27, 2013

(65) Prior Publication Data

US 2014/0161471 A1 Jun. 12, 2014

(30) Foreign Application Priority Data

Dec. 10, 2012 (JP) ..... 2012-269869

(51) Int. Cl.
*G03G 15/08* (2006.01)
*G03G 15/043* (2006.01)

(52) U.S. Cl.
CPC ..... *G03G 15/0812* (2013.01); *G03G 15/043* (2013.01)

(58) Field of Classification Search
CPC ..... G03G 15/0275; G03G 15/0812; G03G 15/043
USPC ..... 399/27, 169, 234, 258
See application file for complete search history.

(56) References Cited

U.S. PATENT DOCUMENTS

| | | | | |
|---|---|---|---|---|
| 5,141,833 | A * | 8/1992 | Kitamori et al. | 430/122.5 |
| 6,374,073 | B2 * | 4/2002 | Ozaki et al. | 399/298 |
| 6,421,514 | B2 * | 7/2002 | Yamanaka et al. | 399/169 |
| 7,415,230 | B2 * | 8/2008 | Kawamura et al. | 399/265 |
| 7,620,334 | B2 * | 11/2009 | Shimizu | 399/30 |
| 8,045,892 | B2 * | 10/2011 | Sakata et al. | 399/254 |
| 2013/0058670 | A1 | 3/2013 | Nakatake et al. | |
| 2013/0236217 | A1 | 9/2013 | Nagatomo et al. | |

FOREIGN PATENT DOCUMENTS

| | | |
|---|---|---|
| JP | 3-077976 | 4/1991 |
| JP | 4-336563 | 11/1992 |
| JP | 2012-208464 | 10/2012 |

* cited by examiner

*Primary Examiner* — Clayton E Laballe
*Assistant Examiner* — Trevor J Bervik
(74) *Attorney, Agent, or Firm* — Duft Bornsen & Fettig LLP

(57) ABSTRACT

An image forming apparatus includes a latent image forming device that forms a latent image, a latent image carrier that carries the latent image, a development device that develops the latent image, and a controller. The development device includes a developer carrier that faces the latent image carrier and carries toner on a rotary surface thereof that rotates in a rotation direction perpendicular to a width direction of the developer carrier, and a regulation member that regulates the thickness of a layer of the toner on the surface of the developer carrier. The controller moves the toner on lateral end regions in the width direction of the surface of the developer carrier toward the latent image carrier. The end regions are located outside a maximum image forming region within a regulation member facing region of the surface of the developer carrier facing the regulation member.

18 Claims, 5 Drawing Sheets

REDUCING TONER ADHESION TO A DEVELOPMENT DEVICE OF AN IMAGE FORMING APPARATUS

CROSS-REFERENCE TO RELATED APPLICATION

This patent application is based on and claims priority pursuant to 35 U.S.C. §119 to Japanese Patent Application No. 2012-269869, filed on Dec. 10, 2012, in the Japan Patent Office, the entire disclosure of which is hereby incorporated by reference herein.

BACKGROUND

1. Technical Field

The present invention relates to an image forming apparatus equipped with a development device using toner.

2. Related Art

In recent years, an image forming apparatus equipped with a development device using toner has been widely used in home offices and by general users. Functional components and techniques employed in the image forming apparatus used in such environments are desired to adjust to reduction in size and cost and extension in life of the image forming apparatus.

For example, components employed in the image forming apparatus have been reduced in size to adjust to the reduction in the overall size of the image forming apparatus. It is therefore more difficult to install the functional components in the size-reduced image forming apparatus than in a large-sized image forming apparatus.

Further, to adjust to the extension in life of the image forming apparatus, the functional components employed in the image forming apparatus are desired to be as abrasion-resistant as possible over an extended period of time. For example, in the case of a photoconductor serving as a latent image carrier, surface abrasion due to contact with components used in charging, development, transfer, and cleaning processes should be taken into account. To minimize the surface abrasion of the photoconductor, a lubricant applicator for applying a lubricant to the photoconductor may be provided. If the photoconductor is reduced in size to adjust to the reduction in size of the image forming apparatus, however, it is difficult to install the lubricant applicator. Therefore, an external additive containing a lubricant such as silicone oil may be added to the toner to reduce friction on the surface of the photoconductor.

Functional components other than the photoconductor, such as a development roller, have also been extended in life for the life extension of the image forming apparatus. Further, as a recent trend, in an image forming apparatus including a process cartridge housing functional components such as a photoconductor and a development device, the functional components of the process cartridge have been improved in durability to reduce running costs. With the functional components thus improved in durability, the frequency of manual replacement of the process cartridge has been reduced, thereby reducing running costs.

If the toner is stored in the process cartridge in an amount corresponding to the lifespan of the durability-improved functional components, however, the size of the process cartridge is increased, thereby increasing the overall size of the image forming apparatus. According to a recent method, therefore, the process cartridge stores a relatively small amount of toner and is resupplied with toner from a toner cartridge. Accordingly, the process cartridge is not required to be filled at one time with all the toner corresponding to the lifespan of the functional components. If the toner cartridge runs out of toner, the toner cartridge is manually replaced with a new toner cartridge to supply toner. Accordingly, the image forming apparatus is reduced in both size and running cost.

If the toner is added with the above-described external additive containing a lubricant, however, the adhesion of toner particles is increased, thereby reducing the fluidity of the toner. The toner with reduced fluidity accumulates in the development device and continues to be subjected to stress. As a result, the toner is thermally fused and may adhere to functional components contacting the toner. Such toner adhesion occurs prominently when the toner has a relatively small particle diameter or a relatively low glass transition temperature Tg. Particularly in a development device including a regulation member that regulates the thickness of a layer of toner carried on the outer circumferential surface of a development roller serving as a developer carrier, toner with reduced fluidity tends to accumulate in a region in which the thickness of the toner layer is regulated by the regulation member. Moreover, the internal pressure (i.e., powder pressure) is increased in the toner accumulating region. Therefore, the toner tends to adhere to end portions of the regulation member in a width direction perpendicular to the moving direction of the outer circumferential surface of the development roller. The toner thus adhering to the end portions of the regulation member may cause an abnormal image such as a striped image.

If the image forming apparatus uses a process cartridge having a relatively short life, the toner adhesion to the end portions of the regulation member in the development device does not pose a serious issue. However, if the image forming apparatus is equipped with a development device using a regulation member and a development roller improved in durability and supplied with toner from a toner cartridge, the development device is used for an extended period of time. In this case, therefore, the toner adhesion to the end portions of the regulation member is prominent.

SUMMARY

The present invention provides an improved image forming apparatus that, in one example, includes a latent image forming device, a latent image carrier, a development device, and a controller. The latent image forming device is configured to form a latent image. The latent image carrier is configured to carry the latent image formed thereon. The development device is configured to develop the latent image on the latent image carrier. The development device includes a developer carrier and a regulation member. The developer carrier is configured to face the latent image carrier and carry toner on a rotary surface thereof that rotates in a rotation direction perpendicular to a width direction of the developer carrier. The regulation member is configured to regulate the thickness of a layer of the toner carried on the surface of the developer carrier. The controller is configured to move the toner carried on lateral end regions in the width direction of the surface of the developer carrier toward the latent image carrier. The end regions are located outside a maximum image forming region within a regulation member facing region of the surface of the developer carrier facing the regulation member.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION

Figure 1:
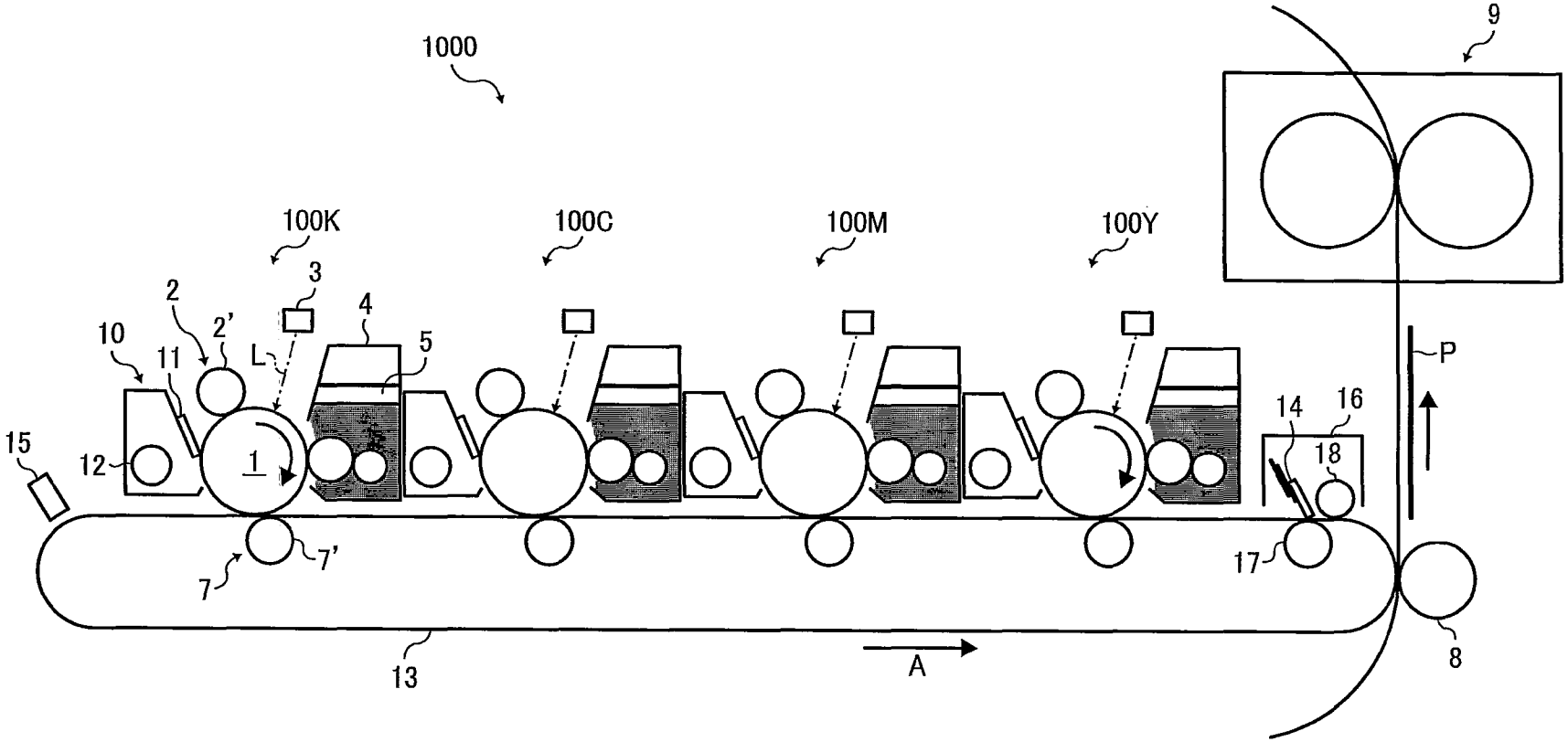
FIG. 1 is a schematic diagram illustrating a configuration example of a tandem electrophotographic image forming apparatus according to an embodiment of the present invention.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, embodiments of the present invention will be described.

FIG. 1 is a schematic diagram illustrating a configuration example of a tandem electrophotographic image forming apparatus 1000 according to an embodiment of the present invention. In FIG. 1, the image forming apparatus 1000 according to the present embodiment includes a plurality of aligned toner image forming units 100Y, 100M, 100C, and 100K for forming toner images of different colors; i.e., yellow (Y), magenta (M), cyan (C), and black (K). The image forming apparatus 1000 further includes an intermediate transfer belt 13, a secondary transfer roller 8, a fixing unit 9, a sensor 15, a belt cleaning unit 16, and a cleaning facing roller 17. In FIG. 1, the reference sign P represents a recording sheet (i.e., recording medium).

The toner image forming units 100Y, 100M, 100C, and 100K are similar in configuration. Therefore, the following description will be given of the toner image forming unit 100K for the black color, and description of the toner image forming units 100Y, 100M, and 100C for the other colors will be omitted.

The toner image forming unit 100K includes a photoconductor drum 1 sequentially surrounded by a charging unit 2, an exposure unit 3, a development unit 5 connected to a toner cartridge 4, a transfer unit 7, and a photoconductor cleaning unit 10. The photoconductor drum 1 serves as a latent image carrier on which a latent image is formed. The charging unit 2 serves as a charging device. The exposure unit 3 serves as an exposure device. The development unit 5 serves as a development device. The transfer unit 7 serves as a transfer device. The photoconductor cleaning unit 10 serves as a latent image carrier cleaning device.

The charging unit 2 includes, for example, a charging roller 2' capable of supplying a predetermined charging bias that uniformly charges the outer circumferential surface of the photoconductor drum 1. The exposure unit 3 includes a light emitting diode (LED) head 31 illustrated in FIG. 5 having a plurality of LEDs aligned in the longitudinal direction (i.e., axial direction) of the exposure unit 3 perpendicular to the drawing plane). The exposure unit 3 performs an exposure process by directing light (e.g., LED light) L for forming a latent image onto the outer circumferential surface of the photoconductor drum 1 uniformly charged by the charging unit 2. The exposure unit 3 may include an optical system including, for example, a laser diode (LD) (i.e., semiconductor laser) capable of modulating the intensity of emitted laser light, and a polygon mirror and an fθ lens for scanning with the laser light emitted from the LD.

The development unit 5 stores toner containing an external additive. In the present embodiment, the toner serves as a one-component developer charged to a predetermined polarity. The development unit 5 causes the toner to adhere to the latent image on the outer circumferential surface of the photoconductor drum 1, to thereby form a toner image. The transfer unit 7 includes, for example, a primary transfer roller 7' serving as a primary transfer member capable of supplying a predetermined transfer bias. The transfer unit 7 transfers the toner image formed on the outer circumferential surface of the photoconductor drum 1 onto the intermediate transfer belt 13 serving as an intermediate transfer member (i.e., a transfer medium to which the toner image is transferred). The photoconductor cleaning unit 10 includes a cleaning blade 11 for removing residual toner from the photoconductor drum 1 and a collected toner transport member 12 for transporting the removed residual toner.

In the present embodiment, the charging unit 2 and the exposure unit 3 cooperate as a latent image forming unit that forms a latent image on the photoconductor drum 1. Further, the charging unit 2, the exposure unit 3, and the development unit 5 cooperate as a toner layer forming unit that forms a toner image (i.e., toner layer) on the photoconductor drum 1. The intermediate transfer belt 13 is stretched around a drive roller and a driven roller (not illustrated), and driven to rotate in the direction of arrow A in FIG. 1.

The toner cartridge 4 serving as a removable toner supply container containing replaceable toner is connected to the development unit 5 to directly transport and supply the toner into the development unit 5. In the illustrated configuration example of the present embodiment, the toner cartridge 4 is disposed at a position adjacent to the upper portion of the development unit 5. Alternatively, the toner cartridge 4 may be disposed at a position inside the image forming apparatus 1000 separated from the development unit 5. In this case, a supply path is provided between the toner cartridge 4 and the development unit 5, and the toner is transported and supplied to the development unit 5 from the toner cartridge 4 through the supply path.

In a usual image forming operation (i.e., image output operation) of outputting an image on a transfer medium performed by the above-configured image forming apparatus 1000, unicolor toner images of the black, cyan, magenta, and yellow colors are formed on the respective outer circumferential surfaces of the photoconductor drums 1. For example, in a so-called negative-positive method which reduces the potential in an exposure region of the photoconductor drum 1 to cause the toner to adhere to the exposure region, the toner image is formed as follows.

The outer circumferential surface of the photoconductor drum 1 is first uniformly charged to negative polarity by the charging roller 2' of the charging unit 2 and then exposed to light by the exposure unit 3, thereby forming an electrostatic latent image. The electrostatic latent image formed on the outer circumferential surface of the photoconductor drum 1 is rendered visible by the toner supplied by the development unit 5 to adhere to the electrostatic latent image, thereby forming a toner image. The toner image is transferred onto the intermediate transfer belt 13 from the outer circumferential surface of the photoconductor drum 1 by the transfer unit 7. Residual toner not transferred to the intermediate transfer belt 13 from the photoconductor drum 1 is removed from the outer circumferential surface of the photoconductor drum 1 by the cleaning blade 11 of the photoconductor cleaning unit 10.

In a secondary transfer region between the intermediate transfer belt 13 and the secondary transfer roller 8, the toner image transferred to the outer circumferential surface of the intermediate transfer belt 13 is transferred onto the recording sheet P fed from a sheet feeding tray (not illustrated) by the secondary transfer roller 8 serving as a secondary transfer device capable of supplying a predetermined transfer bias. Residual toner and external additive remaining on the intermediate transfer belt 13 after the secondary transfer are removed by the belt cleaning unit 16 serving as a belt cleaning device and including a cleaning blade 14 and a coil 18. The toner image transferred to the recording sheet P is fused and fixed thereon by the fixing unit 9 serving as a fixing device and discharged to the outside of the image forming apparatus 1000 through a sheet discharge port (not illustrated).

In the image forming apparatus 1000 illustrated in FIG. 1, the sensor 15 serves as a toner detector that measures the adhesion amount of the toner transferred to the intermediate transfer belt 13 and the positions of the toner images of the respective colors for the adjustment of the image density and registration. The sensor 15 is provided downstream of the toner image forming unit 100K for the black color in the moving direction of the intermediate transfer belt 13. The sensor 15 may be a combination of a regular reflection sensor and a diffuse reflection sensor, for example.

Further, in the belt cleaning unit 16 of FIG. 1, the cleaning blade 14 serves as a cleaning member, and the coil 18 serves as a toner transport device. The cleaning blade 14 is in contact with the intermediate transfer belt 13 in a direction counter to the moving direction of the outer circumferential surface of the intermediate transfer belt 13. The cleaning facing roller 17 made of metal is provided to face the cleaning blade 14 via the intermediate transfer belt 13. The toner removed by the cleaning blade 14 is transported by the coil 18 and stored in a not-illustrated waste toner cartridge serving as a waste toner storing unit.

Figure 2:
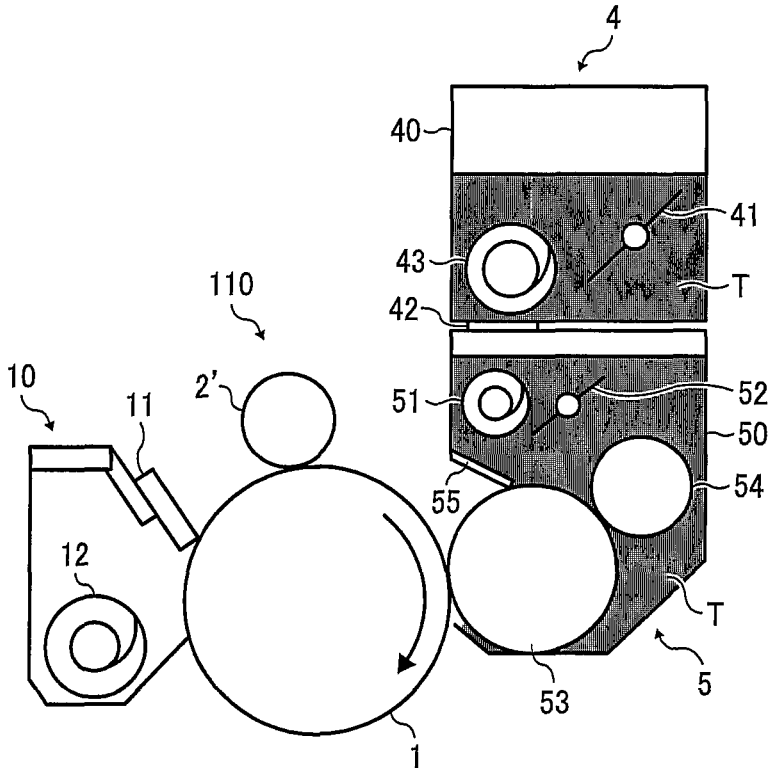
FIG. 2 is a schematic diagram illustrating a configuration example of a process cartridge and a toner cartridge attachable to and detachable from the image forming apparatus according to the present embodiment.

FIG. 2 is a schematic diagram illustrating a configuration example of a process cartridge 110 and the toner cartridge 4 attachable to and detachable from the image forming apparatus 1000 according to the present embodiment. The process cartridge 110 and the toner cartridge 4 in FIG. 2 are commonly applicable to the toner image forming units 100Y, 100M, 100C, and 100K.

The process cartridge 110 in FIG. 2 includes the photoconductor drum 1, the charging roller 2', the development unit 5, and the photoconductor cleaning unit 10. In the present example, the development unit 5 of the process cartridge 110 is connected to the toner cartridge 4.

As illustrated in FIG. 2, the toner cartridge 4 includes a container 40, a mixing paddle 41, a connector 42, and a toner transport device 43, for example. The container 40 stores toner T. The mixing paddle 41 serving as a mixing device constantly mixes the toner T in the container 40 to maintain the fluidity of the toner T in the toner cartridge 4. The connector 42 serves as a toner supply port for supplying the toner T to the development unit 5. The toner transport device 43 is a screw or a coil, for example, for transporting the toner T toward the connector 42. If the toner cartridge 4 is configured to be attachable to and detachable from a position inside the image forming apparatus 1000 separated from the development unit 5, the connector 42 of the toner cartridge 4 is connected to the supply path for supplying the toner T to the development unit 5. The toner transport device 43 is connected to a not-illustrated drive unit (e.g., motor) of the image forming apparatus 1000 by a commonly used drive transmission mechanism such as a clutch to allow the toner transport device 43 to receive rotational drive from the drive unit. The connection and disconnection between the toner transport device 43 and the drive unit are controllable by a later-described control unit 900 illustrated in FIG. 3. Further, the toner cartridge 4 is provided with a remaining toner amount sensor (not illustrated), which is an optical sensor, for example, serving as a remaining toner amount detector that detects the amount of the toner T remaining in the container 40. Accordingly, the toner supply to the development unit 5 is controllable on the basis of the detection result of the remaining toner amount sensor. The amount of toner to be supplied is controllable by the driving time of the drive unit. The driving time of the drive unit is controllable (i.e., changeable) in accordance with a change in toner fluidity depending on the toner color or the hygrothermal environment, for example.

Figure 5:
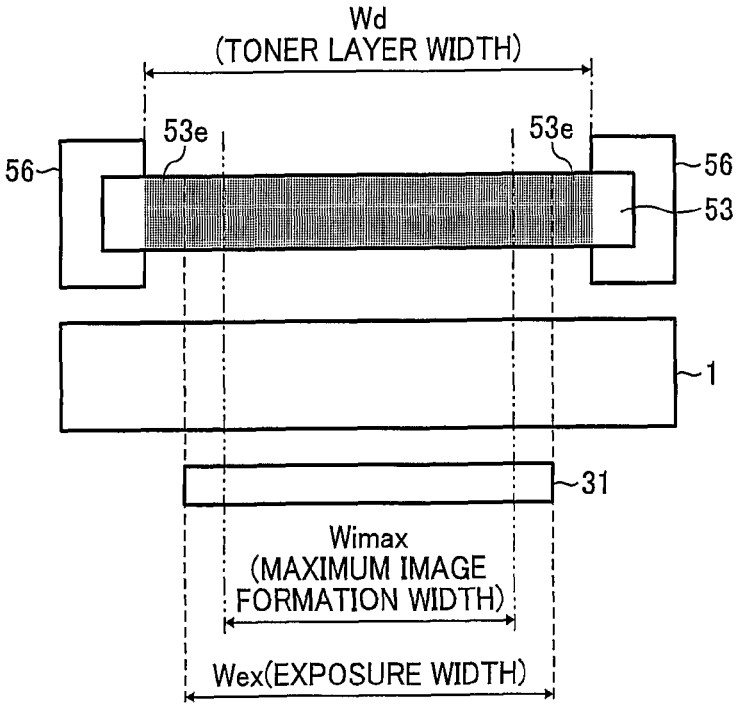
FIG. 5 is a diagram illustrating relative positions of regions in respective outer circumferential surfaces of a photoconductor drum and a development roller and a light emitting diode (LED) head of an exposure unit.

The development unit 5 includes a casing 50 housing a toner transport member 51, an agitator 52, a development roller 53, a supply roller 54, a regulation blade 55, and end seals 56 (the end seals 56 are illustrated in FIG. 5). The toner transport member 51 is a screw or the like serving as a toner transport device. The agitator 52 serves as a mixing device. The development roller 53 serves as a developer carrier (i.e., a toner carrier). The supply roller 54 serves as a supply member. The regulation blade 55 serves as a regulation member. The development unit 5 is provided with power supplies (not illustrated) for supplying voltages of a predetermined polarity and value, i.e., a development bias, a supply bias, and a regulation bias, to the development roller 53, the supply roller 54, and the regulation blade 55, respectively. Opposed end portions of the development roller 53 in the axial direction (i.e., width direction) of the development roller 53 are provided with the end seals 56. The end seals 56 serve as sealing members that prevent the toner T from leaking from the end portions of the development roller 53 in the width direction perpendicular to the moving direction of the outer circumferential surface of the development roller 53.

In the whole area extending in the longitudinal direction (i.e., axial or width direction) of the toner transport member 51 perpendicular to the drawing plane, the toner transport member 51 transports the toner T supplied from the toner cartridge 4 located above the toner transport member 51. The agitator 52 mixes the toner T in the development unit 5. The supply roller 54, which is made of a sponge material, for example, supplies the toner T to the development roller 53. The regulation blade 55 regulates the toner layer thickness, i.e., the amount of the toner T on the development roller 53. The regulation blade 55 also has a function of charging the toner T by causing friction between the toner T and the development roller 53 in a contact area in which the regulation blade 55 is in contact with the development roller 53. The toner layer thickness of the toner T supplied by the supply roller 54 and moved to the development roller 53 is leveled by the regulation blade 55. After the toner layer thickness is thus leveled, the toner T on the development roller 53 moves onto the outer circumferential surface of the photoconductor drum 1 in an amount determined by the surface potential of the photoconductor drum 1, and then is transferred onto the intermediate transfer belt 13 serving as a transfer medium by the transfer unit 7 illustrated in FIG. 1. As described above, a part of the toner T moved to the photoconductor drum 1 remains thereon as post-transfer residual toner, and is removed by the photoconductor cleaning unit 10 and collected by the collected toner transport member 12 into the not-illustrated waste toner cartridge provided inside the image forming apparatus 1000.

Figure 3:
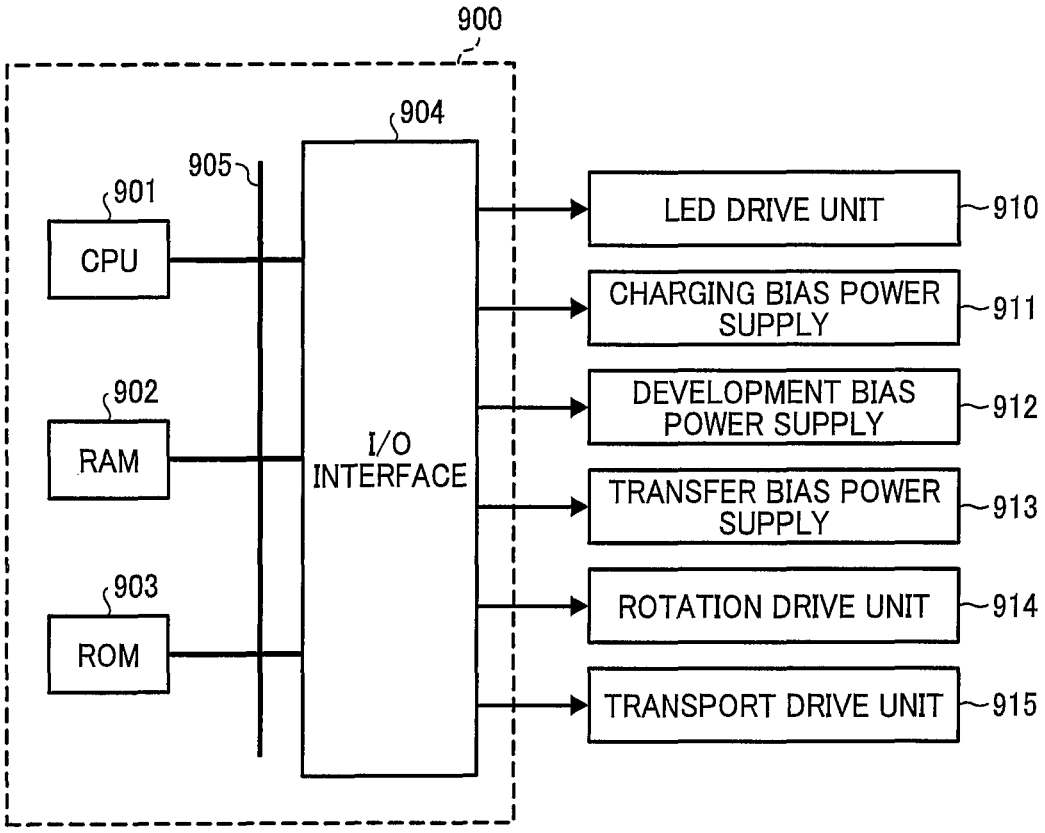
FIG. 3 is a block diagram illustrating a configuration example of related parts of a control system of the image forming apparatus according to the present embodiment.

FIG. 3 is a block diagram illustrating a configuration example of related parts of a control system of the image forming apparatus 1000 according to the present embodiment. In FIG. 3, the control unit 900 serving as a controller is hardware including, for example, a central processing unit (CPU) 901, memories such as a random access memory (RAM) 902 and a read only memory (ROM) 903, and an input/output (I/O) interface 904, connected to one another by a bus 905. When a predetermined control program is read and executed, the control unit 900 controls the above-described units and exchanges data and signals with the units. The control unit 900 may be partially or entirely comprised of devices or electronic components configured to realize predetermined functions. For example, the control unit 900 may be comprised of an electronic circuit element such as an application specific integrated circuit (ASIC), a programmable logic device, or a field programmable gate array (FPGA).

The control unit 900 is connected to an LED drive unit 910, a charging bias power supply 911, a development bias power supply 912, a transfer bias power supply 913, a rotation drive unit 914, and a transport drive unit 915 via the I/O interface 904. The LED drive unit 910 drives the LED head 31 of the exposure unit 3. The rotation drive unit 914 drives and rotates rotary members such as the photoconductor drum 1 and the development roller 53 of the process cartridge 110. The transport drive unit 915 drives sheet feed rollers, transport rollers, sheet discharge rollers, and so forth for transporting the recording sheet P, on which the image is formed.

The control unit 900 controls the LED drive unit 910 to control, for example, the exposure intensity, the exposure width, and the exposure performed on the photoconductor drum 1 by the exposure unit 3. Further, the control unit 900 controls the charging bias power supply 911, the development bias power supply 912, and the transfer bias power supply 913 to control, for example, the value, and the polarity of each of the charging bias, the development bias, and the transfer bias. Further, the control unit 900 controls the rotation drive unit 914 to control, for example, rotational driving of rotary members such as the photoconductor drum 1 and the development roller 53 of the process cartridge 110. Further, the control unit 900 controls the transport drive unit 915 to control, for example, the feed, transport, and discharge of the recording sheet P.

Description will now be given of a toner adhesion preventing operation performed by the above-configured image forming apparatus 1000.

Figure 4:
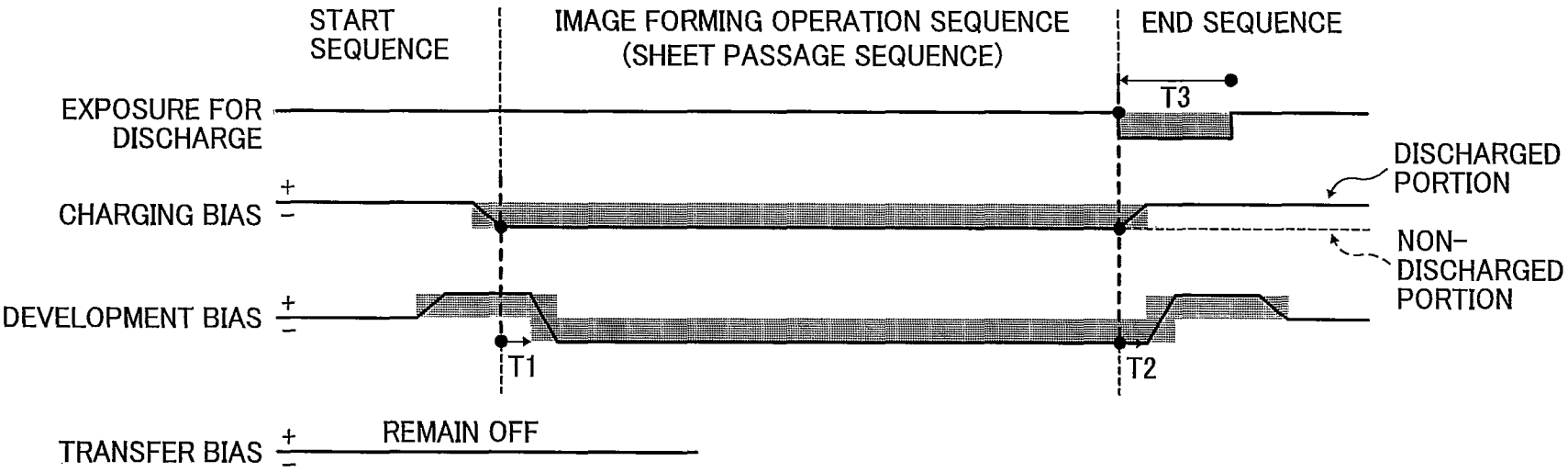
FIG. 4 is a sequence chart illustrating an example of a control sequence of an image forming operation involving a toner adhesion preventing operation performed by the image forming apparatus according to the present embodiment.

FIG. 4 is a sequence chart illustrating an example of a control sequence of an image forming operation involving the toner adhesion preventing operation performed by the image forming apparatus 1000 according to the present embodiment. FIG. 5 is a diagram illustrating relative positions of regions in the respective outer circumferential surfaces of the photoconductor drum 1 and the development roller 53 and the LED head 31 of the exposure unit 3.

In FIG. 4, there is usually a time lag according to the distance between the charging roller 2' and the development roller 53 between the time at which a point of the outer circumferential surface of the photoconductor drum 1 passes a charging position and the time at which the point of the outer circumferential surface of the photoconductor drum 1 passes a development position. In accordance with the time lag, a predetermined time T1 is set between the charging bias supply time and the development bias supply time in an image forming operation start sequence (i.e., hereinafter referred to as the start sequence), and a predetermined time T2 is set between the charging bias supply time and the development bias supply time in an image forming operation end sequence (i.e., hereinafter referred to as the end sequence). For example, in the start sequence of the example in FIG. 4, a development bias of positive polarity for the start sequence shifts to a development bias of negative polarity for an image forming operation sequence upon lapse of the predetermined time T1 after the start of supply of a charging bias of negative polarity. Further, in the end sequence, the development bias of negative polarity for the image forming operation sequence shifts to a development bias of positive polarity for the end sequence upon lapse of the predetermined time T2 after the stop of supply of the charging bias of negative polarity. Each of the predetermined times T1 and T2 in FIG. 4 corresponds to the value obtained by dividing the sum of the distance between the charging roller 2' and the development roller 53 in the moving direction of the outer circumferential surface of the photoconductor drum 1 and a predetermined margin distance by the linear velocity of the outer circumferential surface of the photoconductor drum 1.

Particularly in the end sequence, the value of the charging bias becomes zero, and the development bias of positive polarity inverse to predetermined toner charging polarity (i.e., negative polarity) is supplied. If residual potential remains on the photoconductor drum 1 in the end sequence, the potential difference between the surface potential of the photoconductor drum 1 and the development bias is increased to a substantially large value, causing a phenomenon called "fogging (toner fogging)" in which inversely charged toner charged to the inverse polarity (i.e., positive polarity) is developed. To leave no residual potential on the photoconductor drum 1, therefore, the outer circumferential surface of the photoconductor drum 1 is exposed to light by a predetermined time T3 by the LED head 31 of the exposure unit 3 to be discharged.

Herein, as illustrated in FIG. 5, Wex represents an exposure width, i.e., the width of an exposure region of the outer circumferential surface of the photoconductor drum 1 in the width direction (i.e., axial direction) of the photoconductor drum 1 perpendicular to the moving direction of the outer circumferential surface of the development roller 53, in which the exposure process is performed by the LED head 31 of the exposure unit 3. Further, Wd represents a toner layer width, i.e., the width of a thin toner layer on the development roller 53 corresponding to the width of a region located between the end seals 56. That is, the toner layer width Wd corresponds to the width of a regulation member facing region of the development roller 53 facing the regulation blade 55. Further, Wimax represents a maximum image formation width, i.e., the maximum width of a region of the photoconductor drum 1 extending in the width direction thereof in which the latent image is formed.

The exposure width Wex of the exposure region exposed by the LED head 31 of the exposure unit 3 is narrower than the toner layer width Wd of the thin toner layer on the development roller 53. Therefore, the toner fogging occurs in non-discharged portions of the photoconductor drum 1. That is, the toner on development roller end portions 53*e* moves to the outer circumferential surface of the photoconductor drum 1 and is developed. The toner carried on the development roller end portions 53*e* is developed in the fogging in each end sequence, thereby preventing depleted toner from accumulating around and adhering to the development roller end portions 53*e*. Further, according to the control of the present embodiment, in the start sequence and the image forming operation sequence other than the end sequence, the outer circumferential surface of the photoconductor drum 1 is charged without being subjected to the above-described exposure for discharge, and thus the fogging does not occur. Accordingly, the toner consumption is minimized.

It is conceivable to develop the toner on the development roller end portions 53*e* by increasing the surface roughness of the development roller end portions 53*e* or by applying a relatively low charged material to the development roller end portions 53*e*. That is, if the surface roughness of the development roller end portions 53*e* is increased, the toner amount on the development roller end portions 53*e* is increased, and the charge per toner particle is reduced. The toner reduced in charge per particle is reduced in strength of adhesion to the development roller 53, and thus is easily developed in the fogging. According to the method based on the increase in surface roughness or the application of a relatively low charged material, however, a relatively thick toner layer is constantly formed on the development roller end portions 53*e*, allowing an unnecessarily large amount of toner to be developed (i.e., consumed).

In the present embodiment, the maximum image formation width Wimax is narrower than the exposure width Wex of the exposure region exposed by the LED head 31 of the exposure unit 3. Therefore, the fogging of toner on the development roller end portions 53*e* does not affect the formed image.

Description will now be given of the toner employed in the image forming apparatus 1000 according to the present embodiment. The toner was prepared as follows.

To synthesize polyester 1, 235 parts of bisphenol A ethylene oxide 2 mol adduct, 525 parts of bisphenol A propylene oxide 3 mol adduct, 205 parts of terephthalic acid, 47 parts of adipic acid, and 2 parts of dibutyltin oxide were placed in a reaction vessel equipped with a cooling tube, a stirrer, and a nitrogen inlet tube, and reacted under normal pressure at 230° C. for 8 hours. Then, the mixture was further reacted under reduced pressure of 10 mmHg to 15 mmHg for 5 hours. Thereafter, 46 parts of trimellitic anhydride was placed in the reaction vessel, and the mixture was reacted under normal pressure at 180° C. for 2 hours, thereby obtaining polyester 1 having a number average molecular weight of 2600, a mass average molecular weight of 6900, a glass transition temperature Tg of 44° C., and an acid value of 26.

To synthesize prepolymer 1, 682 parts of bisphenol A ethylene oxide 2 mol adduct, 81 parts of bisphenol A propylene oxide 2 mol adduct, 283 parts of terephthalic acid, 22 parts of trimellitic anhydride, and 2 parts of dibutyltin oxide were placed in a reaction vessel equipped with a cooling tube, a stirrer, and a nitrogen inlet tube, and reacted under normal pressure at 230° C. for 8 hours. Then, the mixture was further reacted under reduced pressure of 10 mmHg to 15 mmHg for 5 hours, thereby obtaining intermediate polyester 1 having a number average molecular weight of 2100, a mass average molecular weight of 9500, a glass transition temperature Tg of 55° C., an acid value of 0.5, and a hydroxyl value of 49. Then, 411 parts of intermediate polyester 1, 89 parts of isophorone diisocyanate, and 500 parts of ethyl acetate were placed in a reaction vessel equipped with a cooling tube, a stirrer, and a nitrogen inlet tube, and reacted at 100° C. for 5 hours, thereby obtaining prepolymer 1 having a free isocyanate percent by mass of 1.53%.

To prepare master batch 1, 40 parts of carbon black (Regal 400R manufactured by Cabot Corporation), 60 parts of binder resin (polyester resin RS-801 manufactured by Sanyo Chemical Industries, Ltd. having an acid value of 10, a weight average molecular weight Mw of 20000, and a glass transition temperature Tg of 64° C.), and 30 parts of water were mixed by a Henschel mixer, thereby obtaining a mixture in which a pigment aggregate is impregnated with water. The mixture was then kneaded with two rolls set to a roll surface temperature of 130° C. for 45 minutes, and pulverized into particles having a diameter of 1 mm by a pulverizer, thereby obtaining master batch 1.

To prepare pigment-wax dispersion 1 (oil phase), 545 parts of polyester 1, 181 parts of paraffin wax, and 1450 parts of ethyl acetate were placed in a vessel equipped with a stirrer and a thermometer, heated to 80° C. while being stirred, kept at 80° C. for 5 hours, and then cooled to 30° C. in 1 hour. Then, 500 parts of master batch 1, 100 parts of a charge control agent, and 100 parts of ethyl acetate were placed in the vessel and mixed for 1 hour, thereby obtaining raw material solution 1. Thereafter, 1500 parts of raw material solution 1 was placed in a vessel and subjected to three passes of processing by a bead mill (Ultra Visco Mill manufactured by Aimex Co., Ltd.) filled to 80 percent by volume with zirconia beads having a bead diameter of 0.5 mm and driven with a liquid feed speed of 1 kg/hr and a disc circumferential velocity of 6 m/sec, thereby dispersing carbon black and wax. Then, 425 parts of polyester 1 and 230 parts of ethyl acetate were added to raw material solution 1, and the mixture was subjected to 1 pass of the processing by the bead mill under the above-described conditions, thereby obtaining pigment-wax dispersion 1. Ethyl acetate was added to raw material solution 1 to adjust the solid concentration of pigment-wax dispersion 1 to 50% when measured after being left at 130° C. for 30 minutes.

To prepare aqueous phase, 970 parts of ion-exchanged water, 40 parts of 25 wt % aqueous dispersion of fine organic resin particles for stabilizing dispersion (copolymer of styrene-methacrylic acid-butyl acrylate-methacrylic acid ethylene oxide adduct sulfate ester sodium salt), 140 parts of 48.5% aqueous solution of sodium dodecyl diphenyl ether disulfonate (Eleminol MON-7 manufactured by Sanyo Chemical Industries, Ltd.), and 90 parts of ethyl acetate were mixed and stirred, thereby obtaining aqueous phase 1, which is lacteous liquid.

An emulsification process was then performed as follows. 975 parts of pigment-wax dispersion 1 and 2.6 parts of isophoronediamine as amines were mixed at 5000 rpm (revolutions per minute) for 1 minute by a T.K. Homo Mixer (manufactured by Tokushu Kika Kogyo Co., Ltd.), mixed with 88 parts of prepolymer 1, and mixed again at 5000 rpm for 1 minute by the T.K. Homo Mixer. Thereafter, 1200 parts of aqueous phase 1 was added to the mixture, and the mixture was mixed for 20 minutes by the T.K. Homo Mixer with the rotation rate adjusted in a range from 8000 rpm to 13000 rpm, thereby obtaining emulsified slurry 1.

A desolvation process was then performed as follows. Emulsified slurry 1 was placed in a vessel equipped with a stirrer and a thermometer and desolvated at 30° C. for 8 hours, thereby obtaining dispersed slurry 1.

A washing and drying process was then performed as follows. 100 parts of dispersed slurry 1 was filtered under reduced pressure, and thereafter the following steps were performed. In a first step, 100 parts of ion-exchanged water was added to a filtered cake obtained by the filtering, and the mixture was mixed by the T.K. Homo Mixer at a rotation rate of 12000 rpm for 10 minutes, and then filtered, thereby obtaining a filtered cake and lacteous filtrate. Then, 900 parts of ion-exchanged water was added to the filtered cake obtained in the first step, and the mixture was mixed with ultrasonic vibration by the T.K. Homo Mixer at a rotation rate of 12000 rpm for 30 minutes, and then filtered under reduced pressure. This operation was repeated until the electrical conductivity of the reslurry was adjusted to 10 μC/cm or less. In a third process, 10% hydrochloric acid was added to the reslurry obtained in the second step to have a pH value of 4, and the mixture was stirred for 30 minutes by a three-one motor, and then filtered. In a fourth step, 100 parts of ion-exchanged water was added to the filtered cake obtained in the third step, and the mixture was mixed by the T.K. Homo Mixer at a rotation rate of 12000 rpm for 10 minutes, and then filtered. This operation was repeated until the electrical conductivity of the reslurry was adjusted to 10 μC/cm or less, thereby obtaining filtered cake 1.

Filter cake 1 was dried at 42° C. for 48 hours by an air circulating drier and sifted through a sieve having a mesh size of 75 μm, thereby obtaining toner base 101 having an average circularity of 0.974, a volume average particle diameter Dv of 6.3 μm, a number-average particle diameter Dp of 5.3 μm, and a Dv/Dp value of 1.19. The thus-obtained toner base 101 was mixed with commercially available fine silica powder by the Henschel mixer, and sifted through a sieve having a mesh size of 60 μm to remove coarse particles and aggregates, thereby obtaining toner.

Specifically, two types of toner (i.e., toner 1 and toner 2) were prepared as follows. To prepare toner 1, 100 parts of toner base 101 obtained by the above-described preparation method was mixed with 1 part of commercially available fine silica powder H20™ (manufactured by Clariant Japan K.K., having an average primary particle diameter of 12 nm, and not subjected to silicone oil treatment) and 2 parts of RY50 (manufactured by Nippon Aerosil Co., Ltd., having an average primary particle diameter of 40 nm, and subjected to silicone oil treatment) by the Henschel mixer, and sifted through a sieve having a mesh size of 60 μm to remove coarse particles and aggregates, thereby obtaining toner 1 added with silicone oil-treated silica. The degree of agglomeration of toner 1 measured by a later-described procedure was 54.4%.

To prepare toner 2, 100 parts of toner base 101 obtained by the above-described preparation method was mixed with 1 part of commercially available fine silica powder H20™ (manufactured by Clariant Japan K.K., having an average primary particle diameter of 12 nm, and not subjected to silicone oil treatment) and 2 parts of RX50 (manufactured by Nippon Aerosil Co., Ltd., having an average primary particle diameter of 40 nm, and not subjected to silicone oil treatment) by the Henschel mixer, and sifted through a sieve having a mesh size of 60 μm to remove coarse particles and aggregates, thereby obtaining toner 2 added with silica not subjected to silicone oil treatment. The degree of agglomeration of toner 2 measured by the later-described procedure was 40.3%.

Figure 6:
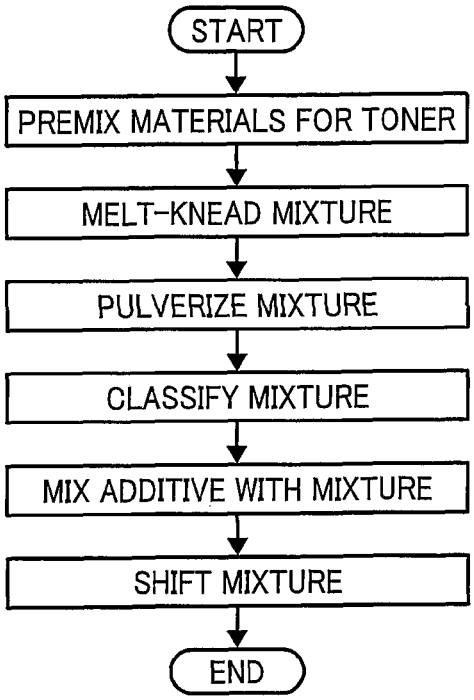
FIG. 6 is a flowchart illustrating a manufacturing process of pulverized toner employed in a comparative example.

Further, black toner used in a commercially available color printer IPSiO SP C310 (manufactured by Ricoh Company Ltd.) was prepared as toner 3. The black toner is pulverized toner different in formula from toner 1 and toner 2 and prepared in accordance with the steps illustrated in FIG. 6.

The degree of agglomeration was measured for each of the above-described toners by a powder tester manufactured by Hosokawa Micton Co., Ltd., which serves as a measurement machine. Accessories such as a vibro chute, packing, a space ring, three types of sieves (i.e., an upper sieve having a mesh size of 75 μm, a middle sieve having a mesh size of 45 μm, and a lower sieve having a mesh size of 20 μm), and a holder bar were sequentially set on a vibration table of the powder tester and fixed by knob nuts. Then, the vibration table was vibrated. The degree of agglomeration was measured under measurement conditions of a vibration width of 1 mm, a sample weight of 2 g, and a vibration time of 10 seconds.

After the measurements performed by the above-described procedure, three formulae of (a) the percentage by mass of the powder remaining on the upper sieve×1, (b) the percentage by mass of the powder remaining on the middle sieve×0.6, and (c) the percentage by mass of the powder remaining on the lower sieve×0.2 were calculated, and the sum of the calculated values of the three formulae (a) to (c) was used as an index of the degree of agglomeration (%).

The glass transition temperature Tg of each of the toners was measured as follows. The glass transition temperature Tg of a sample of a polyester resin or a vinyl-based copolymer resin, for example, for use in the toner was first heated from room temperature to 150° C. at a temperature rise rate of 10° C./min with the use of, for example, a differential scanning calorimeter (e.g., DSC-6220R manufactured by Seiko Instruments Inc.). Thereafter, the sample was left to stand at 150° C. for 10 minutes, cooled to room temperature, and left to stand for 10 minutes. Then, the sample was again heated to 150° C. at a temperature rise rate of 10° C./min. The glass transition temperature Tg was determined from the intersection of a baseline below the glass transition temperature Tg and a tangent of a curve segment indicating the glass transition.

As described above, toner with relatively high fluidity smoothly flows in the development unit 5, and toner with relatively low fluidity agglutinates and accumulates around, for example, the end portions of the regulation blade 55. The accumulating toner is fused by, for example, frictional heat due to the friction between the end seals 56 and the development roller 53 and adheres to the end portions of the regulation blade 55. In the present embodiment, therefore, the toner accumulating around the end portions of the regulation blade 55 is developed on the photoconductor drum 1 to be discharged, thereby keeping the toner fresh around the development roller end portions 53*e* and preventing the toner from adhering to the development roller end portions 53*e*. Further, in the present embodiment, the development and discharge of the toner is limited to the development roller end portions 53*e* by the following method, thereby minimizing the toner consumption.

That is, in the present embodiment, the exposure width Wex of the exposure region of the outer circumferential surface of the photoconductor drum 1 exposed by the exposure unit 3 is narrower than the toner layer width Wd of the thin toner layer on the development roller 53, as illustrated in FIG. 5. With this configuration, therefore, the end portions in the width direction of the outer circumferential surface of the photoconductor drum 1 are not discharged at the step of discharging the photoconductor drum 1 by the exposure process in the end sequence following the image forming operation (i.e., print operation). Further, in the end sequence following the image forming operation, the development bias having a polarity inverse to the normal toner charging polarity is supplied to the development roller 53 for a substantially short time to minimize the toner fogging in accordance with the discharging of the photoconductor drum 1. In the end sequence, therefore, the potential difference between the development bias and the surface potential of the photoconductor drum 1 is increased in the non-discharged end portions of the photoconductor drum 1, thereby causing the depleted inversely charged toner to be developed on the photoconductor drum 1 in the fogging.

Description will now be given of more specific embodiment examples of the above-configured image forming apparatus 1000 and comparative examples.

TABLE 1 illustrates the toner type, the degree of agglomeration (%), the glass transition temperature Tg (° C.), the toner discharge mode, and various evaluations of each of two embodiment examples E1 and E2 and five comparative examples C1 to C5. The evaluations include the evaluation of toner adhesion to the regulation blade 55, the toner consumption (g) and the evaluation thereof, the abrasion amount (μm) of the photoconductor drum 1 and the evaluation thereof, and an overall evaluation.

clutch to the drive source of the process cartridge 110 to be driven thereby, with a drive gear of the toner cartridge 4 connected to the drive source when necessary to allow toner supply. Further, toners 1 to 3 described above were used in the examples.

The evaluations in TABLE 1 were performed as follows.

To evaluate the toner adhesion to the regulation blade 55, the printer was driven in an environment with a temperature of 27° C. and a humidity of 80% with a coverage rate (i.e., print coverage) of 2% until the moving distance of the photoconductor drum 1 reached 5000 m. Further, the printer was supplied with toner in the consumed amount every 1000 m. After the driving, the state of a tip of the regulation blade 55 was observed for evaluation of the toner adhesion level. If there was no toner adhesion, the toner adhesion level was determined to be "good." If there was toner adhesion, the toner adhesion level was determined to be "poor."

TABLE 1

| | E1 | E2 | C1 | C2 | C3 | C4 | C5 |
|---|---|---|---|---|---|---|---|
| toner type | toner 1 | toner 1 | toner 1 | toner 1 | toner 2 | toner 3 | toner 1 |
| degree of agglomeration (%) | 54.4 | 54.4 | 54.4 | 54.4 | 40.3 | 47.8 | 54.4 |
| glass transition temperature Tg (° C.) | 41.3 | 41.3 | 41.3 | 41.3 | 44.1 | 66.1 | 41.3 |
| toner discharge mode | develop toner at roller ends in end sequence | refresh toner at roller ends by exposure | develop toner at roller ends with increased surface roughness | no toner discharge | develop toner at roller ends in end sequence | develop toner at roller ends in end sequence | develop entire toner layer on roller in end sequence |
| evaluation of toner adhesion to regulation blade | good | good | good | poor | good | good | good |
| toner consumption (g) and evaluation thereof | 15.0 good | 16.1 good | 32.2 poor | 12.2 good | 15.4 good | 22.6 good | 36.9 poor |
| photoconductor drum abrasion amount (μm) and evaluation thereof | 1.0 good | 1.0 good | 1.1 good | 1.0 good | 4.4 poor | 4.9 poor | 1.0 good |
| overall evaluation | good | good | poor | poor | poor | poor | poor |

As to the toner discharge mode in TABLE 1, the toner was developed at the development roller end portions 53*e* in the end sequence in embodiment example E1 and comparative examples C3 and C4. In embodiment example E2, the toner was refreshed at the development roller end portions 53*e*. In comparative example C1, the toner was developed at the development roller end portions 53*e* increased in surface roughness. In comparative example C2, the toner discharge was not performed. In comparative example C5, the entire thin toner layer on the development roller 53 was developed in the end sequence.

In embodiment examples E1 and E2 and comparative examples C1 to C5, a color printer IPSiO SP C310 (manufactured by Ricoh Company Ltd.) modified to allow the process cartridge 110 and the toner cartridge 4 illustrated in FIG. 2 to be installed therein was employed as the image forming apparatus 1000. In the printer, the process cartridge 110 was connected to an image forming drive motor to be driven thereby. Further, the toner cartridge 4 was connected via a To evaluate the toner consumption, the toner consumption was measured after the photoconductor drum 1 was driven by a moving distance of 1000 m in a test similar to the above-described test for evaluating the toner adhesion. If the measured toner consumption was less than 30 g, the toner consumption was determined to be "good." If the measured toner consumption was equal to or more than 30 g, the toner consumption was determined to be "poor."

To evaluate the abrasion of the photoconductor drum 1, in each of the above-described tests for evaluating the toner adhesion and the toner consumption, the film thickness of a photosensitive layer of the photoconductor drum 1 was measured by a film thickness measuring apparatus (Fischer Scope MMS manufactured by Fischer Instruments K.K.) before and after the test of driving the photoconductor drum 1 by the moving distance of 5000 m. The evaluation was made on the basis of a reference value of 2.0 μm. That is, if the abrasion amount of the photoconductor drum 1 was less than 2.0 μm, the abrasion was determined to be "good." If the abrasion amount of the photoconductor drum 1 was equal to or more than 2.0 μm, the abrasion was determined to be "poor."

As to the overall evaluation, if the toner adhesion to the regulation blade 55, the toner consumption, and the abrasion of the photoconductor drum 1 were all determined to be "good," the overall evaluation was determined to be "good." If any one of the evaluation items was determined to be "poor," the overall evaluation was determined to be "poor."

In embodiment example E1, toner 1 was used. Further, the exposure width Wex of the exposure region (i.e., the region exposed to light be discharged) of the photoconductor drum 1 was set to be narrower than the toner layer width Wd of the thin toner layer on the development roller 53, and the width of the charging region of the photoconductor drum 1 was set to be wider than the toner layer width Wd. Accordingly, the development of the toner was limited to the development roller end portions 53*e* in the end sequence. In embodiment example E1, the toner adhesion to the regulation blade 55, the toner consumption, and the abrasion of the photoconductor drum 1 were all determined to be good.

Embodiment example E2 and comparative examples C1 to C5 were configured differently from embodiment example E1 as follows.

In embodiment example E2, longitudinal band-like images were printed on lateral ends of an A4 portrait (A4T) sheet every time the moving distance of the photoconductor drum 1 reached 100 m, to thereby refresh the toner. In embodiment example E2, the toner adhesion to the regulation blade 55, the toner consumption, and the abrasion of the photoconductor drum 1 were all determined to be good.

In comparative example C1, the development roller 53 was increased in surface roughness in the end portions thereof as a toner discharge operation mode. As a result, the thin toner layer was increased in thickness at the end portions of the development roller 53, thereby increasing the fogging and thus the toner consumption. Accordingly, the evaluation of the toner consumption was determined to be poor.

In comparative example C2, the toner discharge amount was set to zero. As a result, the toner around the end portions of the development roller 53 was not refreshed and thus adhered to the regulation blade 55. Accordingly, the evaluation of the toner adhesion to the regulation blade 55 was determined to be poor.

Comparative examples C3 and C4 employed toner 2 and toner 3, respectively, which include silica not containing silicone oil. As a result, the evaluation of the abrasion of the photoconductor drum 1 was determined to be poor.

In comparative example C5, the process of exposing the outer circumferential surface of the photoconductor drum 1 to light to discharge the surface was not performed. In each end sequence, therefore, the toner was developed not only in the end portions of the development roller 53 but also in the other portion of the development roller 53, thereby increasing the toner consumption. Accordingly, the evaluation of the toner consumption was determined to be poor.

The above-described embodiments are illustrative and have certain specific effects, including but not limited to the following.

An image forming apparatus according to an embodiment of the present invention (i.e., the image forming apparatus 1000) includes a latent image forming device (i.e., the combination of the charging unit 2 and the exposure unit 3) that forms a latent image, a latent image carrier (i.e., the photoconductor drum 1) that carries the latent image formed thereon, a development device (i.e., the development unit 5) that develops the latent image on the latent image carrier, and a controller (i.e., the control unit 900). The development device includes a developer carrier (i.e., the development roller 53) and a regulation member (i.e., the regulation blade 55). The developer carrier faces the latent image carrier and carries toner on a rotary surface thereof that rotates in a rotation direction perpendicular to a width direction of the developer carrier. The regulation member regulates the thickness of a layer of the toner carried on the surface of the developer carrier. The controller moves the toner carried on lateral end regions in the width direction of the surface of the developer carrier (i.e., the development roller end portions 53*e*) toward the latent image carrier. The end regions are located outside a maximum image forming region (i.e., the maximum image formation width Wmax) within a regulation member facing region (i.e., the toner layer width Wd) of the surface of the developer carrier facing the regulation member.

According to this configuration, the toner carried on the end regions in the width direction of the surface of the developer carrier located outside the maximum image forming region of the regulation member facing region is moved toward the latent image carrier facing the developer carrier. Thereby, toner accumulation leading to toner adhesion is minimized in the end regions, to which the toner reduced in fluidity for a reduction in cost and life extension of the image forming apparatus tends to adhere. Accordingly, the toner adhesion to the development device is prevented for an extended period of time, even if the toner used in the image forming apparatus is increased in degree of agglomeration for a reduction in cost and life extension of the image forming apparatus.

In the above-configured image forming apparatus, the latent image forming device may include a charging device (i.e., the charging unit 2) and an exposure device (i.e., the exposure unit 3). The charging device may charge a charging region of a surface of the latent image carrier. The exposure device may expose an exposure region of the charged surface of the latent image carrier to reduce the potential of the exposure region to which the toner is to adhere, and expose regions of the surface of the latent image carrier facing the end regions of the developer carrier to move the toner toward the exposed regions of the surface of the latent image carrier from the end regions of the developer carrier.

According to this configuration, the charged potential is reduced in the regions of the surface of the latent image carrier facing the end regions of the developer carrier. Accordingly, the toner carried on the end regions of the developer carrier located outside the maximum image forming region is reliably moved toward the latent image carrier facing the developer carrier.

In the above-configured image forming apparatus, with reference to the center in the width direction of the developer carrier, the width of the exposure region exposed by the exposure device (i.e., the exposure width Wex) may be narrower than the width of the regulation member facing region (i.e., the toner layer width Wd). Further, the width of the charging region charged by the charging device may be wider than the width of the regulation member facing region.

According to this configuration, the movement and discharge of the toner toward the latent image carrier is limited to the end regions of the developer carrier, thereby minimizing the consumption of toner not used for the image formation.

In the above-configured image forming apparatus, the controller may be configured to move the toner carried on the end regions of the developer carrier toward the latent image carrier during an ending process (i.e., the end sequence) of an image output operation (i.e., the image forming operation). According to this configuration, the toner on the end regions of the developer carrier is reliably moved and discharged toward the latent image carrier, and the influence of the discharged toner on the image output operation is reduced.

In the above-configured image forming apparatus, the toner may have a degree of agglomeration of 54% or higher. With the use of the toner reduced in fluidity having a degree of agglomeration of 54% or higher, the image forming apparatus is reduced in cost and extended in life. Further, the toner adhesion to the development device is prevented for an extended period of time, even if the toner used in the image forming apparatus is reduced in fluidity having a degree of agglomeration of 54% or higher for a reduction in cost and life extension of the image forming apparatus.

In the above-configured image forming apparatus, the toner may have a glass transition temperature Tg of 42° C. or lower. With the use of the toner having a glass transition temperature Tg of 42° C. or lower, the toner is fixed at a relatively low temperature. Even if the toner used in the image forming apparatus has a relatively low glass transition temperature Tg and thus is easily softened or thermally fused, the toner adhesion to the development device is prevented for an extended period of time.

In the above-configured image forming apparatus, silica particles surface-treated with silicone oil may be added to the toner. According to this configuration, the abrasion of the surface of the latent image carrier is minimized, thereby extending the life of the image forming apparatus and reducing running costs.

The above-configured image forming apparatus may further include a remaining toner amount detector that detects the amount of remaining toner and a toner supply port (i.e., the connector 42) that allows the supply of the toner to the development device from the outside of the development device. According to this configuration, the toner is supplied to the development device from a toner supply container (i.e., the toner cartridge 4) through the toner supply port when the amount of toner remaining in the development device is reduced. Accordingly, a reduction in size and life extension (i.e., a reduction in running cost) of the development device are both attained.

The above-configured image forming apparatus may further include an attachably detachable process cartridge (i.e., the process cartridge 110) integrated with and housing at least the latent image carrier and the development device. According to this configuration, the toner adhesion to the development device is prevented for an extended period of time, even if the toner used in the image forming apparatus is increased in degree of agglomeration for a reduction in cost and life extension of the process cartridge 110.

The above-described embodiments and effects thereof are illustrative only and do not limit the present invention. Thus, numerous additional modifications and variations are possible in light of the above teachings. For example, elements or features of different illustrative embodiments herein may be combined with or substituted for each other within the scope of this disclosure and the appended claims. Further, features of components of the embodiments, such as number, position, and shape, are not limited to those of the disclosed embodiments and thus may be set as preferred. Further, the above-described steps are not limited to the order disclosed herein. It is therefore to be understood that, within the scope of the appended claims, the disclosure of the present invention may be practiced otherwise than as specifically described herein.

What is claimed is:

1. An image forming apparatus comprising:

a latent image forming device configured to form a latent image, the latent image forming device including;

a charging device configured to charge a charging region of a surface of the latent image carrier; and an exposure device configured to expose an exposure region of the charged surface of the latent image carrier to reduce the potential of the exposure region to which the toner is to adhere, and expose regions of the surface of the latent image carrier facing the end regions of the developer carrier to move the toner toward the exposed regions of the surface of the latent image carrier from the end regions of the developer carrier;

a latent image carrier configured to carry the latent image formed thereon; and a development device configured to develop the latent image on the latent image carrier, the development device including:

a developer carrier configured to face the latent image carrier and carry toner on a rotary surface thereof that rotates in a rotation direction perpendicular to a width direction of the developer carrier;

a regulation member configured to regulate the thickness of a layer of the toner carried on the surface of the developer carrier; and a controller configured to move the toner carried on lateral end regions in the width direction of the surface of the developer carrier toward the latent image carrier, the end regions located outside a maximum image forming region within a regulation member facing region of the surface of the developer carrier facing the regulation member.

2. The image forming apparatus according to claim 1, wherein, with reference to the center in the width direction of the developer carrier, a width of the exposure region exposed by the exposure device is narrower than a width of the regulation member facing region, and a width of the charging region charged by the charging device is wider than the width of the regulation member facing region.

3. The image forming apparatus according to claim 1, wherein the controller is configured to move the toner carried on the end regions of the developer carrier toward the latent image carrier during an ending process of an image output operation.

4. The image forming apparatus according to claim 1, wherein the toner has a degree of agglomeration of 54% or higher.

5. The image forming apparatus according to claim 1, wherein the toner has a glass transition temperature Tg of 42° C. or lower.

6. The image forming apparatus according to claim 1, wherein silica particles surface-treated with silicone oil are added to the toner.

7. The image forming apparatus according to claim 1, further comprising:

a remaining toner amount detector configured to detect the amount of remaining toner; and a toner supply port configured to allow supply of the toner to the development device from outside of the development device.

8. The image forming apparatus according to claim 1, further comprising:

a detachable process cartridge integrated with and housing at least the latent image carrier and the development device.

9. The image forming apparatus according to claim 1, wherein the latent image carrier comprises a photoconductive drum.

10. The image forming apparatus according to claim 9, wherein the exposure region is on an outer circumferential surface of the photoconductive drum.

11. The image forming apparatus according to claim 10, wherein the developer carrier comprises a developer roller.

12. The image forming apparatus according to claim 11, wherein a width of the exposure region is narrower than a width of the layer of the toner on the developer roller.

13. The image forming apparatus according to claim 12, wherein the width of the layer of the toner corresponds to a region located between end seals located on either end of the developer roller.

14. The image forming apparatus according to claim 12, wherein the width of the exposure region is perpendicular to a movement direction of an outer circumferential surface of the developer roller.

15. The image forming apparatus according to claim 12, wherein the width of the exposure region is in an axial direction of the photoconductive drum.

16. The image forming apparatus according to claim 15, wherein the exposure device includes an array of light emitting diodes arranged in the axial direction of the photoconductive drum.

17. The image forming apparatus according to claim 16, wherein the exposure region exposed by the array of light emitting diodes is narrower than the width of the layer of the toner on the developer roller.

18. An image forming apparatus comprising:

a latent image forming device configured to form a latent image;

a latent image carrier configured to carry the latent image formed thereon; and a development device configured to develop the latent image on the latent image carrier, the development device including:

a developer carrier configured to face the latent image carrier and carry toner on a rotary surface thereof that rotates in a rotation direction perpendicular to a width direction of the developer carrier;

a regulation member configured to regulate the thickness of a layer of the toner carried on the surface of the developer carrier; and a controller configured to move the toner carried on lateral end regions in the width direction of the surface of the developer carrier toward the latent image carrier, and to move the toner carried on the end regions of the developer carrier toward the latent image carrier during an ending process of an image output operation, the end regions located outside a maximum image forming region within a regulation member facing region of the surface of the developer carrier facing the regulation member, wherein residual potential remains on the latent image carrier during the ending process of the image output operation, and wherein the controller is configured to direct an exposure device to expose an exposure region of the charged surface of the latent image carrier to reduce the residual potential.

* * * * *